US005537780A

United States Patent [19]

Cleaver et al.

[11] Patent Number: 5,537,780

[45] Date of Patent: Jul. 23, 1996

[54] LOUVER MECHANISM FOR PALLADIAN WINDOWS

[75] Inventors: Jay R. Cleaver, Lafayette; Richard E. LaMay; Bradford D. King, both of West Lafayette, Ind.

[73] Assignee: Lafayette Venetian Blind, Inc., West Lafayette, Ind.

[21] Appl. No.: 349,676

[22] Filed: Dec. 5, 1994

[51] Int. Cl.[6] ..... E06B 7/086

[52] U.S. Cl. ..... 49/82.1

[58] Field of Search ..... 49/74.1, 82.1; 160/134, 84.07; 454/221, 224, 278

[56] References Cited

U.S. PATENT DOCUMENTS

| | | | |
|---|---|---|---|
| 705,202 | 7/1902 | Buckman | 49/82.1 X |
| 3,075,257 | 1/1963 | Rosen | 49/74.1 X |
| 4,860,492 | 8/1989 | Roy | 49/82.1 |
| 5,052,150 | 10/1991 | Chen | 49/82.1 |
| 5,216,837 | 6/1993 | Cleaver et al. . | |
| 5,379,551 | 1/1995 | Swapp | 49/82.1 |

*Primary Examiner*—Jerry Redman

*Attorney, Agent, or Firm*—Woodard, Emhardt, Naughton Moriarty & McNett

[57] ABSTRACT

A fan-like array of louvers around a hub in a half-circle shaped frame is adapted to cover a Palladian-style window. Two facing ring gear sectors are slidable in a channel in the hub to turn about an axis that is common to the half-circle, the channel bottom and the arc of the window. A series of pinions has pinion teeth between and engaged with the two gears, each pinion receiving a drive pin therein, each of which has a point directed away from the gear and embedded in a louver. A pivot pin has a point rotatably received in the opposite end of each louver and an outer end received and spring loaded in a blind hole in the outer, arched, frame member. A drive motor in the hub has a pinion with teeth between and engaged with the gears to drive the gears simultaneously but in opposite directions, thus turning the louvers in unison to open and shut them as and to the extent desired.

8 Claims, 3 Drawing Sheets

LOUVER MECHANISM FOR PALLADIAN WINDOWS

BACKGROUND OF THE INVENTION

1. Field of the Invention

This invention relates generally to window coverings and more particularly to shutters or louvers for windows, and still more particularly to such apparatus for Palladian-style windows.

2. Description of the Prior Art

Various louvers and shutters are discussed in the background of a prior art U.S. Pat. No. 5,216,837 issued Jun. 8, 1993 to Cleaver et al. That particular patent discloses and describes a system whereby all louvers in a window or door covering assembly are operable simultaneously by an arrangement of pinions and gear racks whereby, upon turning one of the louvers to provide the amount of closure desired, the rest of the louvers turn simultaneously in synchronism with them.

Palladian-style windows, which are increasingly popular, and shuttering for them, as well as simultaneous synchronized closing and opening of them, is desirable. The present invention is addressed to that need.

SUMMARY OF THE INVENTION

Described briefly, according to a typical embodiment of the present invention, a set of louvers is disposed in an array around a center point in a frame for adaptation to a Palladian-style window. Two ring gear sectors are disposed face-to-face with their arc center on the center line of the arc of the window. A series of pinions is disposed between and engaged with the teeth of the two gear sectors. Each of these pinions receives one end of a drive pin whose other end has a point directed away from the gear sector and embedded in a louver. A pivot pin has a point received in the opposite end of the louver and a head portion slidably received and spring loaded in a blind hole in the arched portion of frame of the assembly. The meshing of the pinion of each louver with the ring gear sectors provides for the simultaneous operation of all of the louvers in synchronism. A remotely controlled motor located inboard of the array of louvers drives a pinion disposed between and engaged with the ring gear sectors whereby it will drive the ring gear sectors in opposite directions to simultaneously drive the pinions of the louvers and thereby the louvers, to open or shut them to the degree desired.

DESCRIPTION OF THE PREFERRED EMBODIMENT

Figure 1:
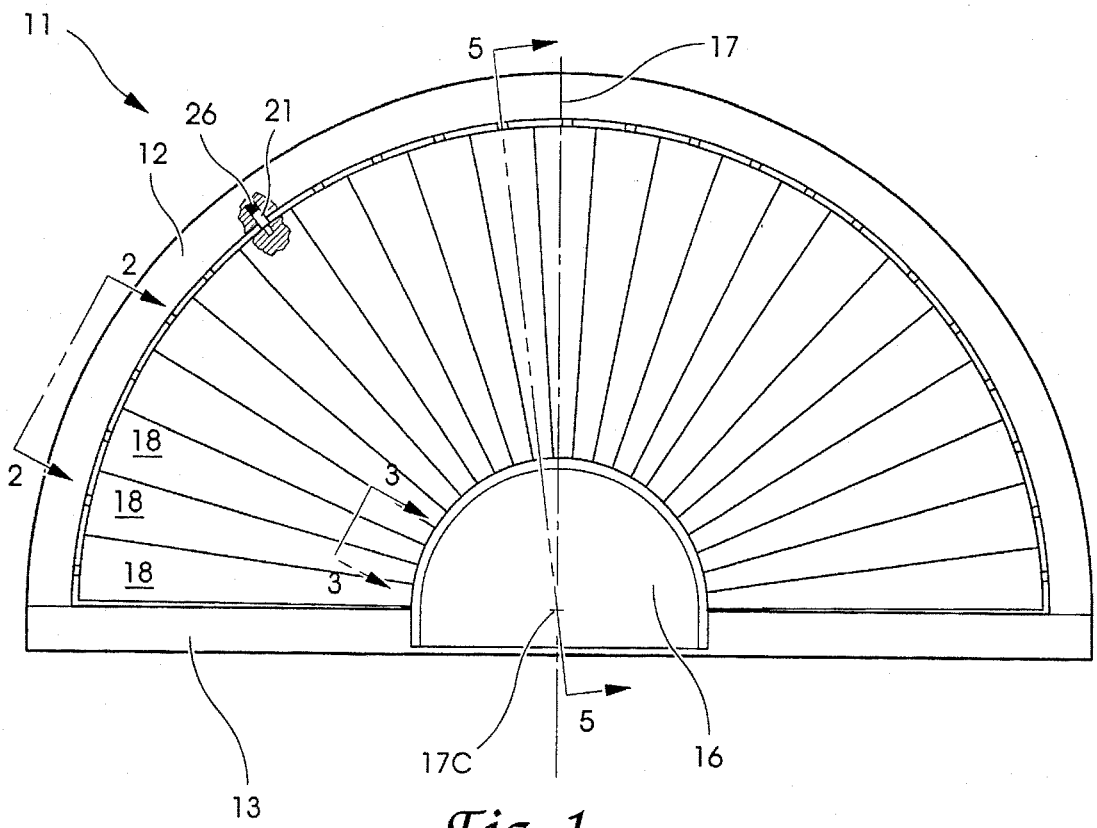
FIG. 1 is a front elevational view of a louvered window covering assembly for a Palladian-style window.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, the illustrated louver assembly 11 has a frame built up of wood and including an outer frame arch or bow 12 and a base 13. A mechanism cover plate 14 made of wood is located at the center of the base and has the arcuate outer surface 16 centered on line 17 as are the bow 12 and the other features of the assembly. A cover plate such as 14 is also provided on the opposite face of the assembly. The louver assembly of the present invention is typically provided on the inside of the window, although it could be used on either outside or inside.

Figure 2:
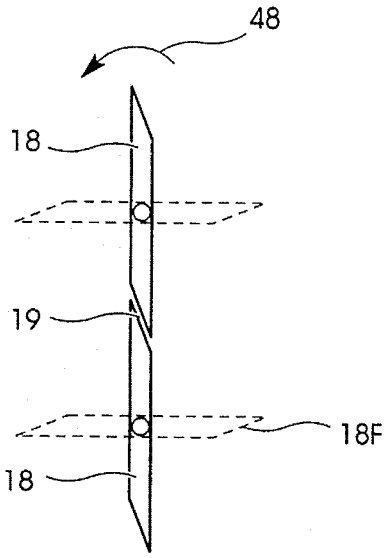
FIG. 2 is a cross section taken at line 2—2 in FIG. 1 and viewed in the direction of the arrows and showing overlap of the louvers when closed; with dashed lines showing them open.

An array of louvers 18 is provided and, when they are shut as shown in FIG. 1, there is a slight overlap between the adjacent louvers as shown at 19 in FIG. 2. The louvers can be turned to a full opened position such as shown at 18F in FIG. 2. They can be turned farther than that, if desired for any reason, particular interior lighting effects with sunlight, for example.

Figure 4:
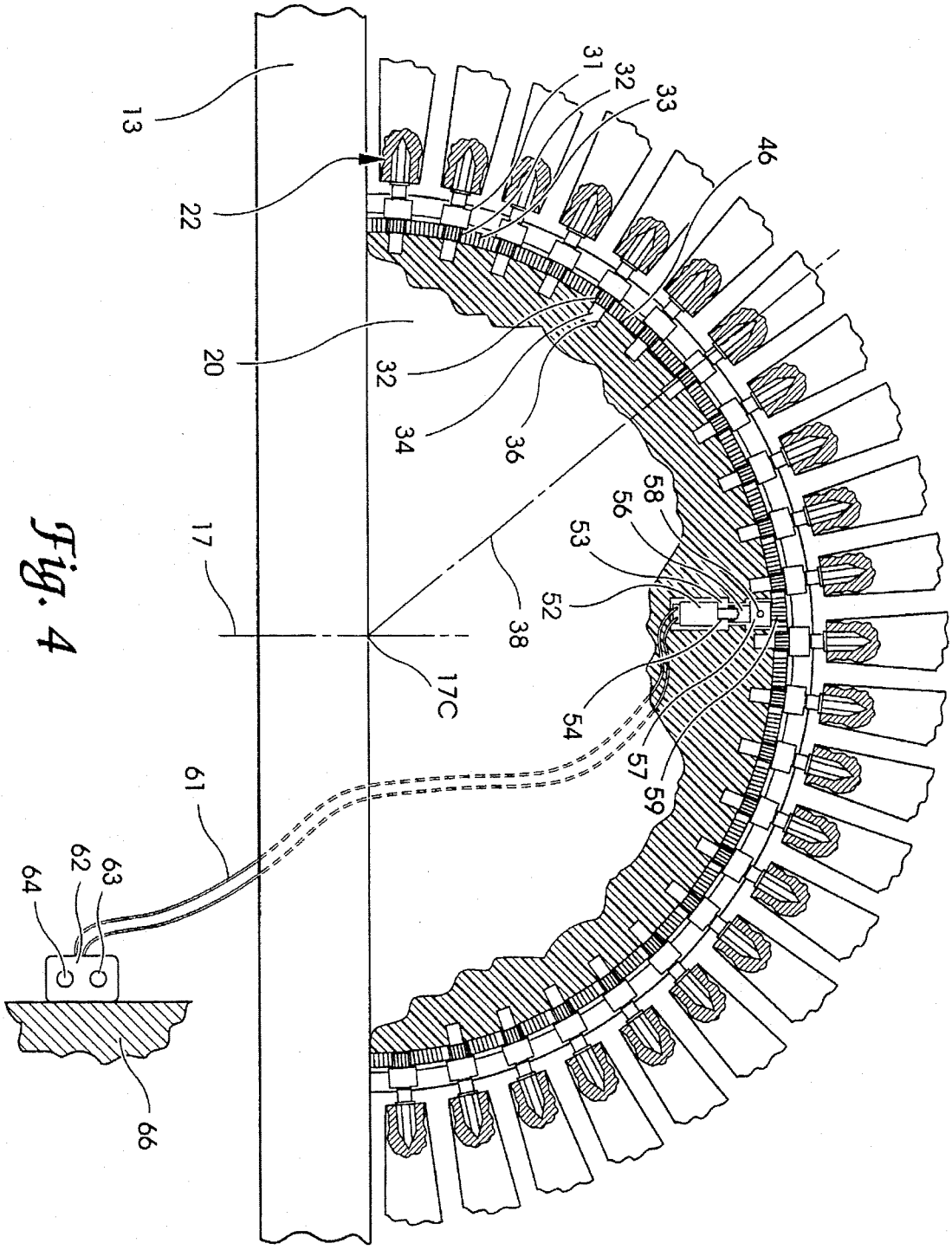
FIG. 4 is an enlarged frontal view of hub and proximal ends of louvers of the assembly but with the upper front portion of the hub and the front portion of the inner ends of the louvers broken away to expose the details of the operating mechanism, and with the louvers partly open.
Figure 5:
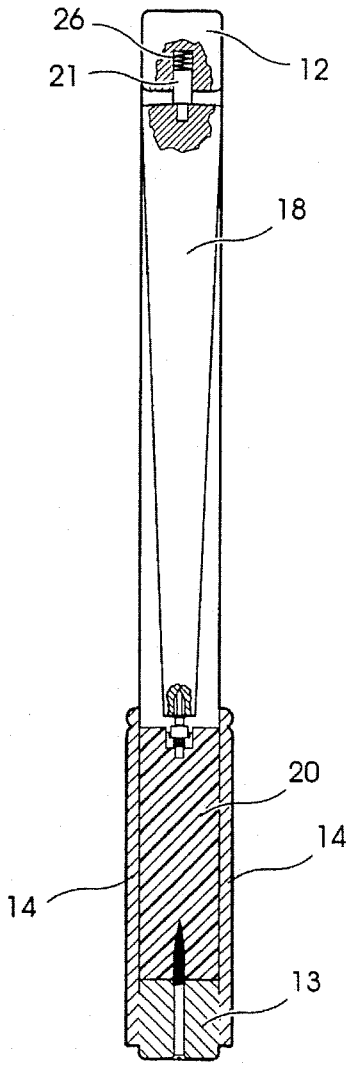
FIG. 5 is a vertical section at line 5—5 in FIG. 4.

As shown in FIGS. 4 and 5, a circular segment 20 of UHMW plastic is mounted atop frame base 13 and secured to it by screws. It serves as a hub for mounting the louvers and operating mechanism. The covers 14 are fixed to the front and back faces of hub 20 by staples.

Each of the louvers is provided with a pivot pin such as 21 at the outer end, and drive pin 22 at the inner end. The cylindrical head of the pin 21 is slidably received in a cylindrical blind hole in the bow 12 and spring loaded by coil spring 26 seated in the closed end of the hole. The point of the pivot pin is rotatably fitted in a hole in the outer end of the louver.

Figure 3:
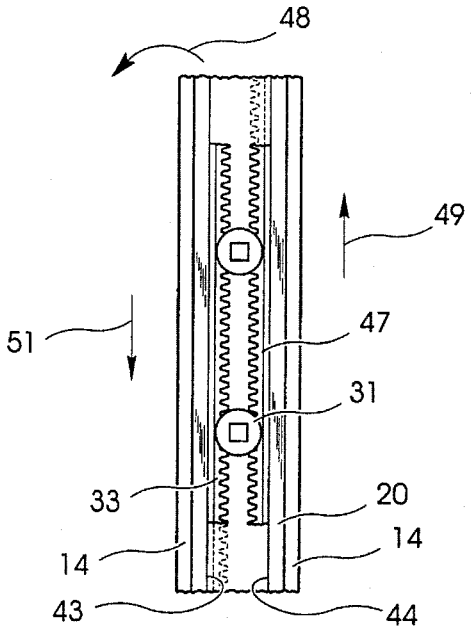
FIG. 3 is a section taken at line 3—3 in FIG. 1 and viewed in the direction of the arrows and showing the relationship of the gear portions controlling the two louvers shown in FIG. 2, showing them in solid outline with the louvers closed and in dashed outline with the louvers full open.
Figure 5A:
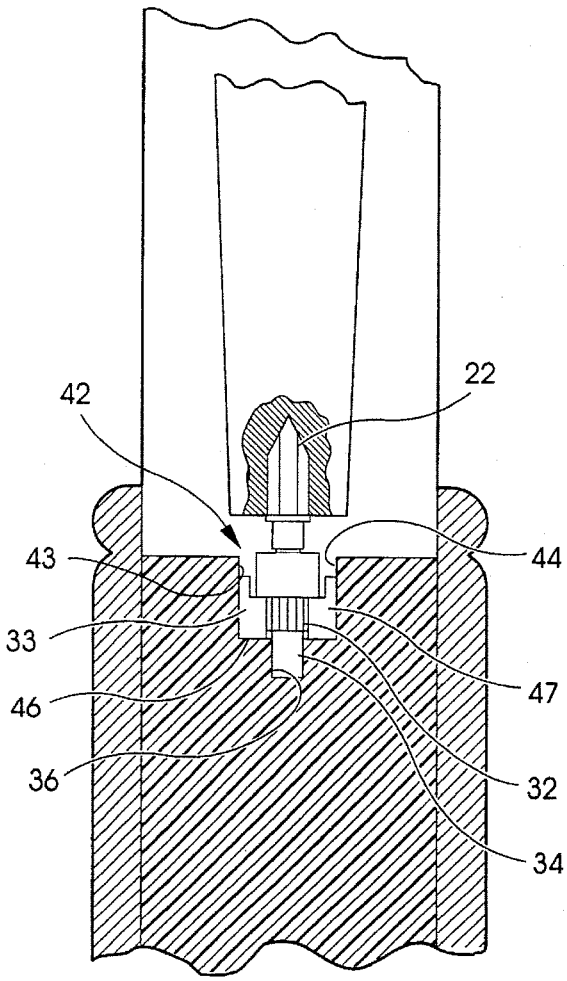
FIG. 5A is an enlargement of a portion thereof.
Figure 6:
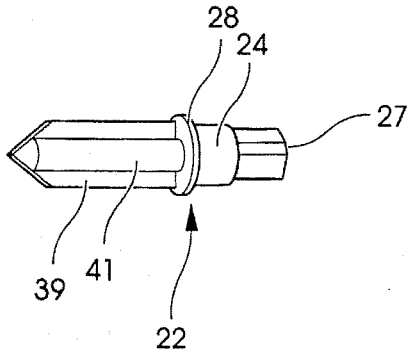
FIG. 6 is a pictorial view of a drive pin.
Figure 7:
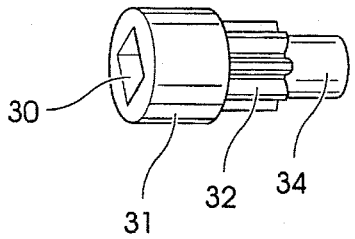
FIG. 7 is a pictorial view of a drive pinion unit.

Pin 22 is shown in FIG. 6 herein and in the aforementioned Cleaver et al. patent at 56, the disclosure of which patent is incorporated herein by reference. Each pin 22 has a pointed blade end non-rotatably embedded in the louver, a circular stop flange 28 and cylindrical flange-base 24. The pin has the square post portion 27 at the opposite end slidably received in a square socket 30 in the head 31 of a pinion. The pinion teeth 32 are between and engaged with the teeth of ring gear sectors 33 and 47 (FIGS. 3, 5 and 5A). FIG. 4 shows the lower post end 34 of the pinions received in sockets 36 in hub 20. The fit of the square drive posts 27 of the drive pins 22 in the square sockets 30 of the pinions provides positive drive. The fit of the cylindrical posts 34 in the sockets 36 in the hub 20 is such as to permit the pinions to freely rotate in the hub but maintain the pinions in proper alignment in the frame, with the pinion axes such as 38 passing through the arc center 17C on line 17 at the top of the base 13. If desired, posts 34 and sockets 36 can be omitted for all except one of the louvers, as that one can serve to establish the proper relationship of the gears. The embedded blade portion of drive pin 22 includes two ribs 39 (FIG. 6) projecting from stop flange 28 along opposite sides of the pin hub 41 centered on the pin axis. The ribs prevent rotation of the louver relative to the pin.

The hub 20 has an outwardly facing groove or channel 42 whose center of curvature is at point 17C at the top center of the frame base 13. Two walls 43 and 44 of the channel cooperate with the bottom 46 of the channel whose arc is also centered at 17C, to receive and guide gear sectors 33 and 47, respectively. Even if only one pinion has locator bearing post 34 fittingly but rotatably received in matching socket 36 in the hub 20, it will maintain its location with respect to the hub. Therefore, whenever this pinion turns, the sector gears are "turned" (moved in the channel 42 around the center 17C) but in opposite directions. Therefore, as any louver turns in the counterclockwise direction of arrow 48 (FIGS. 2 and 3), sector gear 33 moves in the direction of arrow 51 and the sector gear 47 moves in the direction of arrow 49, so all of the other louvers turn likewise. A turn of the louvers 90° about their axes such as 38, coincides with movement of the gear sectors in the direction of the arrows approximately a distance shown by the dotted lines as dictated by the pitch diameter of the pinions.

All pinions other than the one with the locator post 34, being constantly in mesh with the gear sectors as is that pinion, remain in place while turning without the need for locator posts. Their flat lower ends rest in and are borne by the channel bottom as they turn.

Drive for the gear sectors may be provided by an electric motor 52 secured in cavity 53 in the hub 20. The output shaft 54 of motor 52 is received in a downwardly-opening socket in pinion shaft 56 and secured by a setscrew. Drive pinion base 57 has a downwardly opening socket receiving the upper end of shaft 56 and is secured to the shaft by a rollpin 58. The pinion teeth 59 are received in the teeth of the gear sectors 33 and 47 in the same manner as are louver pinion teeth 32. Therefore, when the motor is operated, the gear sectors are driven in directions depending on the direction of motor rotation.

Electric power to the motor is provided through wires 61 which extend through the back (window side) of the back cover 14 to a remote controller 62 with forward and reverse switch buttons 63 and 64, the controller being conveniently located in the room as on a wall 66, for example.

It is preferable for the drive pins, pinions, and gear sectors to be made of plastic, nylon or Delrin brand material being preferred. Materials other than these and those mentioned above with reference to the frame, louvers and hub, might also be used. It should be understood that the invention will function with arcs of more or less than 180° about a center such as 17C.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A covering unit for a window opening in a wall and comprising:

a frame including an arched member and a hub;

a plurality of elongate louvers having longitudinal axes and having distal ends adjacent the arched member and having proximal ends adjacent the hub;

a ring gear sector adjacent ends of the louvers;

louver drive pins engaging the louvers;

pinions engaging the gear sector and receiving the louver drive pins, each pinion having a rotational axis with a permanent location in the unit; and a drive motor having a pinion with a permanent location in the unit and engaging the gear sector, whereby operation of the motor causes movement of the gear sector to cause simultaneous turning of the louvers about their axes.

2. The unit of claim 1 and further comprising:

a track in the hub and receiving the gear sector therein, the gear sector being slidable in the track about the center of the gear sector as the motor drive pinion turns in driving relation to the gear sector.

3. The unit of claim 2 and further comprising:

a second ring gear sector engaged by the pinions;

a second track in the hub and receiving the second sector therein, the second sector being slidable in the second track about the center of the second sector as the motor drive pinion turns in driving relation to the second sector.

4. The unit of claim 2 and wherein:

louver pivot pins are connected to the louvers at the distal end; and the louver drive pins are attached to the louvers at the proximal ends of the louvers and have drive stems fittingly and non-rotatably located in sockets in the pinions receiving the drive pins whereby the pins at the proximal ends serve to turn the louvers about their axes as the gear sector is driven by the motor and slides in the track.

5. The unit of claim 4 and wherein:

the frame includes a base member;

the arched member extends for 180 degrees from one end of the base member to the other end of the base member;

the hub is at the center of the base member; and the track in the hub has a curved outer bearing surface in a semicircle about an axis centered between ends of the base member.

6. The unit of claim 5 and wherein:

the hub is made of a plastic having a low friction bearing surface; and the pinions connected to the louvers by the drive pins have faces bearing on the outer bearing surface of the hub.

7. A covering unit for a window opening in a wall and comprising:

a plurality of louvers, each having a longitudinal axis;

a curved outer locator for the louvers;

a curved inner locator for the louvers;

one of the locators including a curved track;

a curved gear slidable along the track;

a plurality of pinions engaging the gear;

a motor having a pinion engaging and driving the gear;

means preventing movement of the pinions along the curved track as the gear is driven by the motor; and means providing connections between the louvers and the plurality of pinions.

8. The unit of claim 7 and wherein:

the outer locator and inner locator are held in fixed relation to each other.

* * * * *